United States Patent [19]

Klatt

[11] Patent Number: 4,823,880

[45] Date of Patent: Apr. 25, 1989

[54] GASWELL DEHYDRATE VALVE

[75] Inventor: Wayne Klatt, Medicine Hat, Canada

[73] Assignee: 374928 Alberta Limited, Canada

[21] Appl. No.: 244,782

[22] Filed: Sep. 15, 1988

[30] Foreign Application Priority Data

Jun. 16, 1988 [CA] Canada ..... 569610

[51] Int. Cl.[4] ..... E21B 21/00; E21B 34/12; E21B 34/16

[52] U.S. Cl. ..... 166/373; 166/330; 166/369; 166/386

[58] Field of Search ..... 166/330, 373, 369, 386

[56] References Cited

U.S. PATENT DOCUMENTS

| | | | |
|---|---|---|---|
| 2,720,926 | 10/1955 | Brown | 166/330 |
| 2,815,925 | 12/1957 | Fisher, Jr. | 166/330 X |
| 2,858,099 | 10/1958 | Althouse, Jr. et al. | 166/330 X |
| 2,874,931 | 2/1959 | Baker et al. | 166/330 X |
| 3,493,052 | 2/1970 | Evans et al. | 166/373 |
| 3,497,009 | 2/1970 | Harrington | 166/330 |
| 3,829,245 | 8/1974 | Evans | 417/108 |
| 4,465,435 | 8/1984 | Copas | 417/56 |
| 4,573,536 | 3/1986 | Lawrence | 166/373 |

*Primary Examiner*—Stephen J. Novosad
*Attorney, Agent, or Firm*—Price, Heneveld, Cooper, DeWitt & Litton

[57] ABSTRACT

A threaded sleeve valve to facilitate the removal of water from gas wells having two or more gas productive zones disposed vertically along their bore. The valve is adapted to form a connection between a segregation packer and a well tubing string. In use, the valve and the segregation packer are sunk in the well to a position intermediate an upper gas productive zone and a lower gas productive zone. During normal gas production, the valve is closed and gas is collected from both zones, the gas from the lower zone passing through a vertical passage defined by the valve and continuous with the interior of the well tubing. Incidental water accumulated above the segregation packer can be removed by opening the valve and using the gas pressure of the lower productive zone to force the accumulated water upwards to the wellhead and out of the well. Once the well bore has been purged of incidental water, the valve is re-closed and normal production resumes. The valve is operated from the surface by turning the well tubing string in the required direction.

12 Claims, 5 Drawing Sheets

GASWELL DEHYDRATE VALVE

The present invention relates to natural gas well equipment and, more specifically, to a novel threaded sleeve value for removing water from an upper region of a gas well bore which passes through two or more gas productive zones.

Natural gas well bore often pass through two or more gas productive zones. Incidental ground water seepage into natural gas wells is a recognized problem in the industry, especially in the regions of the bore which is relatively near the surface. As ground water rises within a gas well bore, it creates a hydrostatic pressure which may overweigh the gas pressure of the gas productive zones communicating with the well bore. If this occurs, natural gas stops flowing from the well and the well is said to be "killed". In order to resume gas production, the water must be removed from the bore of the well. There are several known methods of removing incidental ground water from natural gas wells. One method involves pumping the water from a gas well, however this is a very expensive operation and if ground water seeps into a well at a rapid rate, the expense of maintenance can render the well uneconomical. For this reason, devices have been invented for the removal of incidental ground water from gas wells using gas pressure to propel the accumulated water to the surface.

One such device is taught in U.S. Pat. No. 3,829,245 which described a small diameter purge pipeline containing sections which have a permanently open inlet port. The sections are disposed at intervals along the length of the purge pipeline. The inlet ports admit water and gas into the purge line and since the purge line has a small diameter in relation to the well casing, the water is raised to the wellhead and blown out of the well. This apparatus has several disadvantages in that it functions efficiently only in wells haveing single gas productive formation and a good natural gas pressure. In addition, because of the mixing of water and gas promoted by multiple inlet ports spaced apart in vertical relationship along the length of the purge pipeline, a wate and gas separator is required at the well head or large quantities of hydrocarbon are lost to the atmosphere.

In gas wells having bores which pass through two or more gas productive zones, the lower gas productive zones of the well bore commonly yield gas at a higher pressure than the upper zone(s) of the bore. The pressure differential between the gas in the upper zone(s) and gas in the lower zone(s) is often great enough that gas cannot be collected from an upper zone unless that zone is segregated from lower zone(s), thereby relieving the pressure on the upper zone and permitting gas to flow from that region of the bore. In order to segregate an upper gas productive zone from a lower gas productive zone of a well bore, one or more well tubings are sunk within the production casing of the well and segregation packers are set to create a seal between the production casing and a well tubing string or between the inside of one well tubing string and the outside of another. Segregation packers are well known in the art and are commonly available, typically comprising donut-shaped rubber, cloth, brass and steel constructions. Segregation packers not only separate the productive zones in a gas well, permitting gas to be collected from each zone, they also prevent the migration of incidental ground water from the upper regions to the lower regions of the bore.

Traditionally, incidential ground water has been removed from deep, multi-zoned gas wells using a device commonly known as a "slick line" and a "sliding sleeve valve". In use, a sliding sleeve valve is connected in a well tubing string just above a segragation packer. When water collects above the segregation packer and slows or stops production in that gas productive zone of the well, the sliding sleeve valve is pulled open by means of a cable called a slick line to allow the generally higher pressures of the lower gas productive zones to blow the water out through an open valve at the wellhead. The problem with this equipment is the unreliability of its operation. Sliding sleeve valves are extremely susceptible to the intrusion of sand, grit and other foreign matter often found in gas well ground water. As a result, sliding sleeve valve often seize in either an open or closed position and must be pulled from the well and cleaned to be of further service. This is a costly and dangerous operation which limits the profitability of the well and almost inevitably leads to the discharge of considerable amounts of hydrocarbon into the atmosphere.

The present invention provides a novel valve for purging gas wells of incidental water. The valve of the invention may be repeatedly opened and closed without the necessity of pulling a well tubing string to clean the valve or maintain the valve in any other manner.

It is an especial advantage of the invention that it provides a valve for purging incidental water from gas wells which is operable from the wellhead with hand tools commonly available at natural gas well sites, obviating the need for valve control cables or other remote control devices which are susceptible to corrosion and mechanical failure.

Thus, according to the present invention, there is provided a sleeve valve for use in a gas production well, said valve adapted for connection to a well tubing string and operable to selectively open or close communication between the exterior of said tubing string and the interior of said tubing string and said valve comprising:

inner and outer valve components defining a continuous bore therethrough, said inner component being axially fixed but rotatable relative to said second component;

said inner component being adapted for attachment to said well tubing string with said valve bore communicating with the interior of said string and said inner component secured for rotation with said string;

said outer component adapted for attachment to means restraining said outer component from rotating with said inner component;

one or more ports extending through said outer component from the vale bore to the exterior of said valve;

sealing means between said inner and outer valve components preventing the passage of fluids or gases between said components;

a valve sleeve threadedly engaged with said inner component and axially slidable within said outer component but rotationally restrained whereby rotation of said inner component translates to axial movement of said valve sleeve within said outer component between respective positions wherein the or each said port is are blocked or exposed by said valve sleeve; and sealing means between said inner and outer valve components preventing the passage of fluids or gases between said components.

Usually, the outer component is adapted for connection to a segregation packer for said well, which serves to restrain the outer component from turning with the inner component.

In a preferred embodiment, the valve comprises a pair of hollow mandresl interconnected in a rotatable, coaxial relationship by a pair of collets and an elongated tubular sleeve. Roller bearings are provided between the moving parst to ensure reliable performance and O-rings are provided at critical points to prevent the intrusion of sand or other contaminants between the components of the valve. Threadably engaging the lower end of the first or upper mandrel is a valve sleeve member having a sealing region located within a seal bore of the second or lower mandrel. The valve sleeve member is provided with an exterior vertical groove along a portion of its length in its middle region. A pin fitted in a hole in the wall of an elongated tubular sleeve attached to the second or lower mandrel rides in this groove to prevent the valve sleeve member from rotating relative to the seal bore of the second mandrel. Thus when the first mandrel is rotated and the second mandrel is held stationary, the action of the threaded engagement of the valve sleeve member with the first mandrel forces the sealing region of the valve sleeve member upwards or downwards within the seal bore of the second mandrel, depending on the direction of rotation. The sealing region of the valve sleeve member is provided with a series of small rings and a neoprene band seal or wear ring which sealingly abut the seal bore of the second mandrel. The seal bore of the second mandrel is provided on one end with several spaced apart coplanar radial bores which communicate with the exterior walls of the valve. Thus, when the valve sleeve member is raised to its uppermost or open position, the radial bores in the seal bore are open and gas can pass from the vertical passage defined by the coaxial hollow mandrels to the exterior of the valve. Conversely, when the valve sleeve is lowered to its lowermost or closed position, the radial bores in the lower mandrel are closed by the wear ring and gas is prevented from escaping the vertical passage of the valve.

The preferred embodiment of the invention will now be described by way of example only and with reference to the following drawings wherein.

Figure 1:
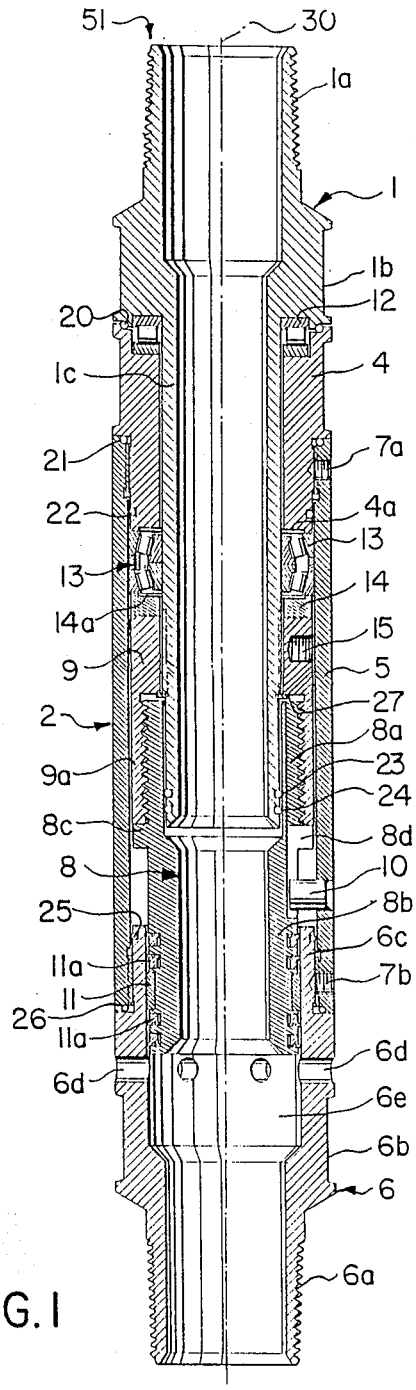
FIG. 1 is a detailed cross section of a valve according to the invention, showing the valve in an open condition.

Referring to the drawings, FIG. 1 illustrates a cross section of a threaded sleeve valve 51 in accordance with the invention. In general terms, the valve comprises an inner component and an outer component generally referred to by the references 1 and 2 respectively. The inner component 1 includes a collet 9 rotatably secured thereto, as will be described in more detail hereinafter. Threadably engaging the collet 9 at the lower end of the inner component 1 is a valve sleeve member generally referred to by the reference 8. Each of the components 1 and 2 and the valve sleeve member 8 is provided with a longitudinal bore. The component 1 and 2 are rotatably interconnected in a coaxial relationship to form a vertical passage 30 which is continuous through the valve. The outer component 2 is pierced with a series of radial bore 6d in a spaced apart coplanar relationship. A pin 10 driven through a complementary horizontal bore in a side of the outer component 2 rides in a vertical groove 8d in valve section member 8, preventing the valve sleeve member from rotating within the outer component. Thus, when inner component 1 is rotated clockwise relative to the outer component 2, the valve sleeve member 8 is urged downward by the interaction of the threads 8a of the member 8 and **9*a* of the collet 9 to close the bores 6*d* and, conversely, when the inner component 1 is rotated counterclockwise, the valve sleeve is urged upward to open bores 6*d***. The specific use and function of the valve will be explained hereinafter in detail.

Turning now to a detailed description of the valve of the invention and referring once again to FIG. 1, the inner component 1 of the valve comprses a hollow mandrel provided on its upper end wiht a spiral thread **1*a* for the attachment of a well tubing string, as will become apparent. An annular exterior shoulder region 1b provides a housing on its lower edge for a roller bearing 12. The elongated barrel 1c of the inner component 1 may be integral with the mandrel as illustrated, or may comprise a separate hollow cylinder which threadably engages (not illustrated) the lower end of the annular shoulder 1*b*. Attached by threaded engagement with a lower region of barrel 1*c* is the collet 9. The collet 9 is locked in its engagement with the barrel 1*c* by set screws 15. The engagement of collet 9 is further reinforced by a C-ring retaining clip 27 which engages a complementary groove in the barrel 1*c* of inner component 1. The collet 9 is further provided with a radially enlarged, annular recess having sprial thread 9a on its lower end which engages complementary spiral thread 8a on the exterior surface of the upper end of the valve sleeve member 8. The valve sleeve member 8** will be described in more detail below.

The outer component 2 of the valve comprises a hollow mandrel 6 on its lower end. The hollow material is provided on its free end with an exterior sprial thread **6*a* for the attachment of a segregation packer, as will also become apparent. An annular exterior shoulder region 6*b* is provided with a seal bore 6*e* on its inner surface and the aforementioned series of spaced apart coplanar radial bores 6*d* which communicate between the exterior surface of shoulder 6*b* and the seal bore 6*e***.

The outer component 2 also comprises an elongated tubular sleeve 5 threadably engaging a short barrel region **6*c* of mandrel 6. The tubular sleeve 5 is locked in its engagement with mandrel 6 by set screws 7*b*. Tubular sleeve 5 also threadably engages a collet 4 on its opposite end and is locked in its engagement therewith by sets screws 7*a*. The upper end of the collet 4 is provided with the complementary lower portion of the housing for bearing 12. The bearing 12 provides vertical rotational support between the inner component 1 and the outer component 2** of the valve.

Sandwiched between the collet 4 of the outer component 2 and collet 9 of the inner component 1 are a pair of juxtaposed radial thrust bearings 13 which maintain the two components in axial alignment. The lower end of the collet 4 is provided with a relieved region **4*a* so that the collet 4 only contacts the outer perimeter of the cage of the upper bearing 13. A washer 14 is interposed between collet 9 and the lower thrust bearing 13. The washer 14 is also provided with a relieved region 14a** to limit the contact of the washer to the outer perimeter of the lower bearing cage.

The inner and outer components of the valve, and each part thereof are provided with O-ring seals to prevent the intrusion of sand, water or other foreign materials between the parts of the valve as well as the passage of gas from vertical passage 30 to the exterior of the valve when the radial bores 6d are closed by valve sleeve member 8. An O-ring 20 seals the housing for bearing 12 from the intrusion of foreign matter. O-rings 21 and 22, respectively located at the upper and lower ends of the threaded connection between collet 4 and tubular sleeve 5 prevent the intrusion of foreign matter into the housing for bearings 13. O-rings 25 and 26 seal the threaded connection between mandrel 6 and tubular sleeve 5. Likewise, the O-rings 23 and 24 form a seal between the barrel 1*c* of the upper mandrel and the upper inside surface of the valve sleeve member 8.

A series of four polymer sealing rings 11a, spaced in pairs on each side of a neoprene band seal, or wear ring, 11 form a seal between valve sleeve 8b of the valve sleeve member 8 and the seal bore 6*e* of the lower mandrel 6. It is thus apparent that both the exterior surfaces and the walls of the vertical passage 30 of the valve are impervious to the passage of gases, fluids or abrasive particles, protecting the mechanism of the valve from undue wear or malfunction due to the intrusion of contaminants.

The valve sleeve member 8 is provided with the coarse spiral thread 8*a* on its upper end and the valve sleeve 8*b* on its lower end. An annular exterior shoulder region 8*c* limits the vertical travel of the valve sleeve member 8 from a position where the upper edge of shoulder 8*c* abuts the lower end of collet 9 to a position where the lower edge of shoulder 8*c* abuts the upper edge of mandrel barrel 6*c*. The valve sleeve member 8 is further provided with the aforesaid narrow vertical groove 8*d* within which the substantially round pin 10 is free to slide. The pin 10 is driven through and secured by a horizontal bore piercing the side of the tubular sleeve 5. The pin 10 serves to prevent the rotation of valve sleeve member 8 while permitting the vertical displacement thereof within the limits heretofore described. It is thus apparent that by retaining the outer component 2 in a fixed position while rotating the inner component 1 in the required direction, radial bores 6*d* may be opened or closed by the vertical displacement of valve sleeve member 8 due to the interaction of spiral threads 8*a* and 9*a*.

The use of the valve of the invention will now be explained by referecne to FIGS. 2 through 5.

Figure 2:
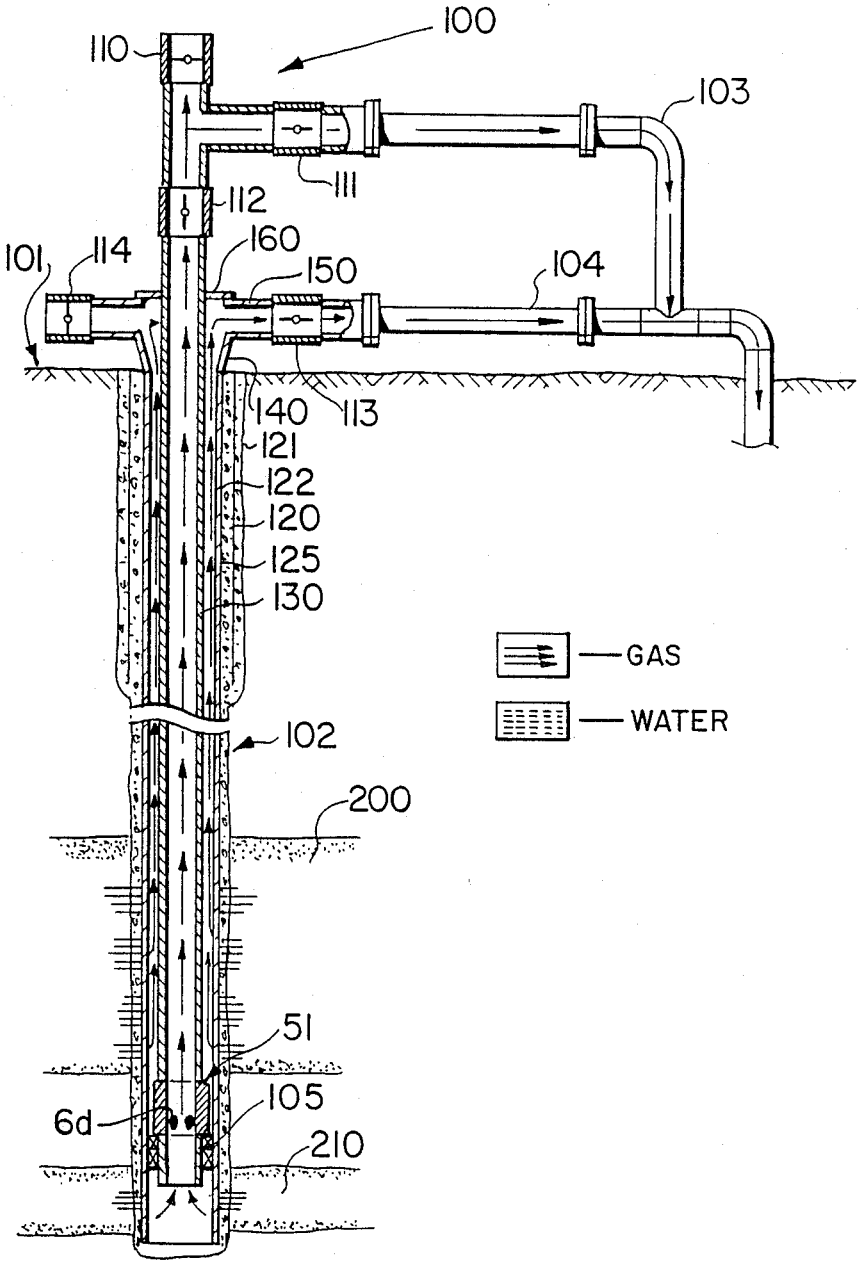
FIG. 2 is a schematic view of the valve of FIG. 1 installed in a productive natural gas well.

FIG. 2 shows a typical productive gas well, generally referred to by the reference 100, equipped with the valve 51 of the invention. The gas well comprises a cylindrical bore 102 which extends from the ground surface 101 to a deep gas productive zone 210. Below the ground surface 101, the well comprises a surface casing 120, a production casing 125 and a well tubing 130. The sapce between the bore 102 and the surface casing 120 is filled with a specific oil and gas well cement 121. Likewise, the space between the surface casing and the production casing is filled with another specific cement 122. The production casing 125 extends from the wellhead to the bottom of the well bore in one continuous string. It is pierced with an abundance of small holes in its lower regions to permit the natural gas to pass from the gas productive formations into the interior of the casing.

The well equipment above the ground surface 101 is commonly referred to as a "well tree". The well tree comprises all the connectors, valves and flanges required to control and direct the natural gas into collection pipelines 103 and 104. In the well tree illustrated, a casing bowl 140 is flanged to the production casing 125. A cross-flow tee 150 is connected to the top of the casing bowel 140 and provided wiht two control valves 113 and 114 respectively. Sealingly affixed to the top of the cross-flow tee 150 is a cross flow tee cap 160 having a vertical bore to sealingly accommodate the passage of the well tubing 130. The well tubing 130 is further provided with the control valves, 110, 111 and 112 respectively, to control and direct the flow of gas from the well tubing.

As is apparent from FIG. 2, the gas well bore extends downward from teh surface through two gas productive zones 200 and 210. Since, generally speaking, zone 210 yeilds gas at higher pressure than zone 200, it is desirable to segregate the two productive zones to permit the collection of gas from each zone. Without segregation, the gas pressure of the lower zone 210 overweighs the gas pressure from the upper zone 200 and gas cannot be collected from each zone. Segregation of the productive zones 200 and 210 is accomplished by sinking the well tubing string 130 provided on its lower end with a segregation packer 105. Segregation packers are well known in the art. In the gas well illustrated in FIG. 2, the well tubing string 130 is attached to a valve 51 according to the invention which is in turn connected to the segregation packer 105. The valve serves to control communication between the outside and inside of the tubing string 130, through the bores 6d of the valve. Natural gas from productive zone 210 rises through the vertical passage defined by the segregation packer 105, the valve 51 and the well tubing string 130 and enters collector line 103 which connects with a gas pipeline. Gas from the productive zone 200 rises within the production casing 125 around the periphery of the well tubing string 130 and enters collector line 104 which also connects with the gas pipeline. The radial bores 6*d* in valve 51 (see FIG. 1) are closed and segregate the higher pressures of the gas productive zone 210 from the lower pressures of the gas prductive zone 200.

Figure 3:
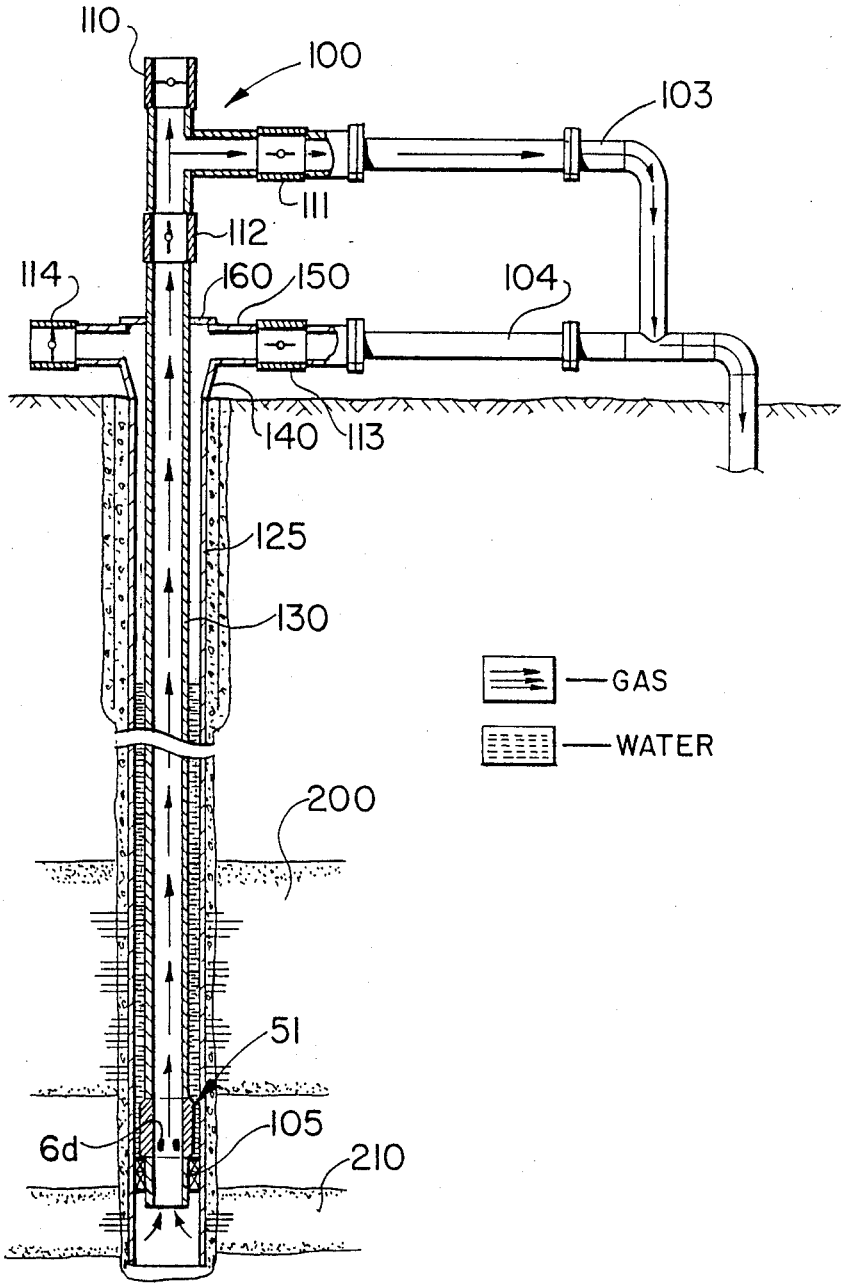
FIG. 3 is a schematic view of the gas well of FIG. 2, the upper productive zone of the well having been killed by the accumulation of incidental water above the segregation packer.

FIG. 3 illustrates the well of FIG. 2 in an often encountered condition wherein incidental ground water, having seeped into the upper region of the well bore, has risen within the bore of the well between the production casing and the well tubing to the point that the hydrostatic pressure has killed gas production in that region ofthe bore. Gas production continues from the deeper productive zone 210, however, as there is little or no ground water in that region of the bore and the valve 51 and segregation packer 105 prevent water from migrating into that region of the well. In order to resume gas production from zone 200 of the well, the incidental water must be removed.

Figure 4:
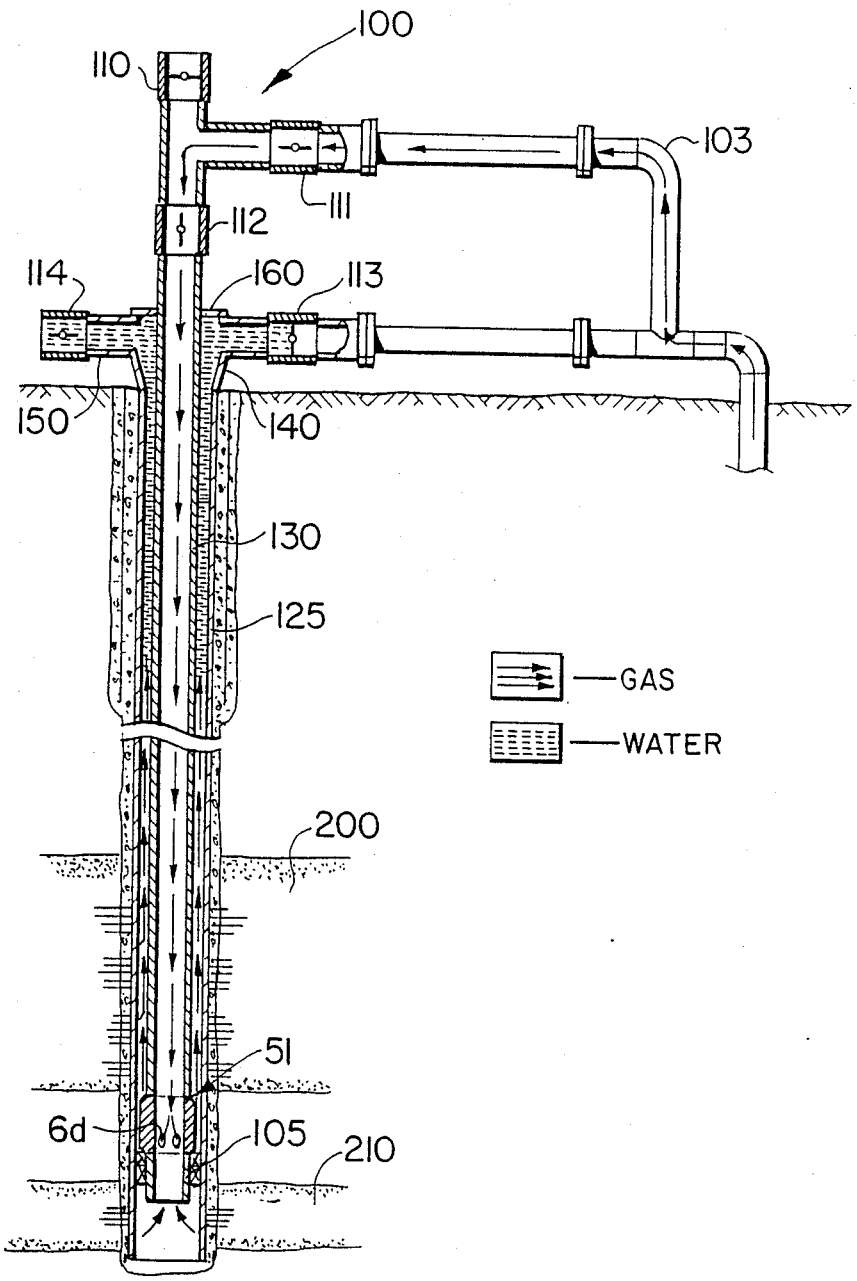
FIG. 4 illustrates the removal of the incidental water shown in FIG. 3.

Referring now to FIG. 4, the incidental water may be removed from the well by opening the radial bores 6d in the valve 51 (see FIG. 1) to permit the gas pressure from the lower gas productive zone 210 to lift the water column to the surface. Before the valve 51 is opened, valve 113 on cross-flow tee 150 is closed to prevent water from entering the gas pipeline. The valve 114 on the opposite side of the cross-flow is opened and a hose is connected therefrom to a disposal tank (not illustrated).

The valve 51 is rotatably locked with the well tubing string 130 and the valve is operated from the wellhead by rotating well tubing string 130 in the appropriate direction with a suitable wrench. The connections between the well tubing string 130, the cross-flow tee cap 160 and the valve 112 permit the rotation of the well tubing string in a manner well known in the art. Therefore, by gripping the well tubing string between the valve 112 and the cross-flow tee cap 160 with a pipe wrench or an equivalent tool, the well tubing string may be rotated to operate the valve 51 from the well tree, by transmitting rotation to the inner component 1 of the valve (see FIG. 1).

Normally, if there is good gas pressure in the lower region of the well, valve 112 on the top of the well tubing is closed and the gas pressure from the well itself is used to lift the column of water to the wellhead. If, however, the column is too heavy to be lifted by the gas pressure of the well, the reserves from the pipeline may be used to lift the water by setting the proper control valves (not illustrated) to permit the gas volume and pressure of the pipeline itself to travel down the well tubing and augment the pressure of the well to raise the water to the wellhead. The flow of gas in accordance with this option is illustrated in FIG. 4.

Figure 5:
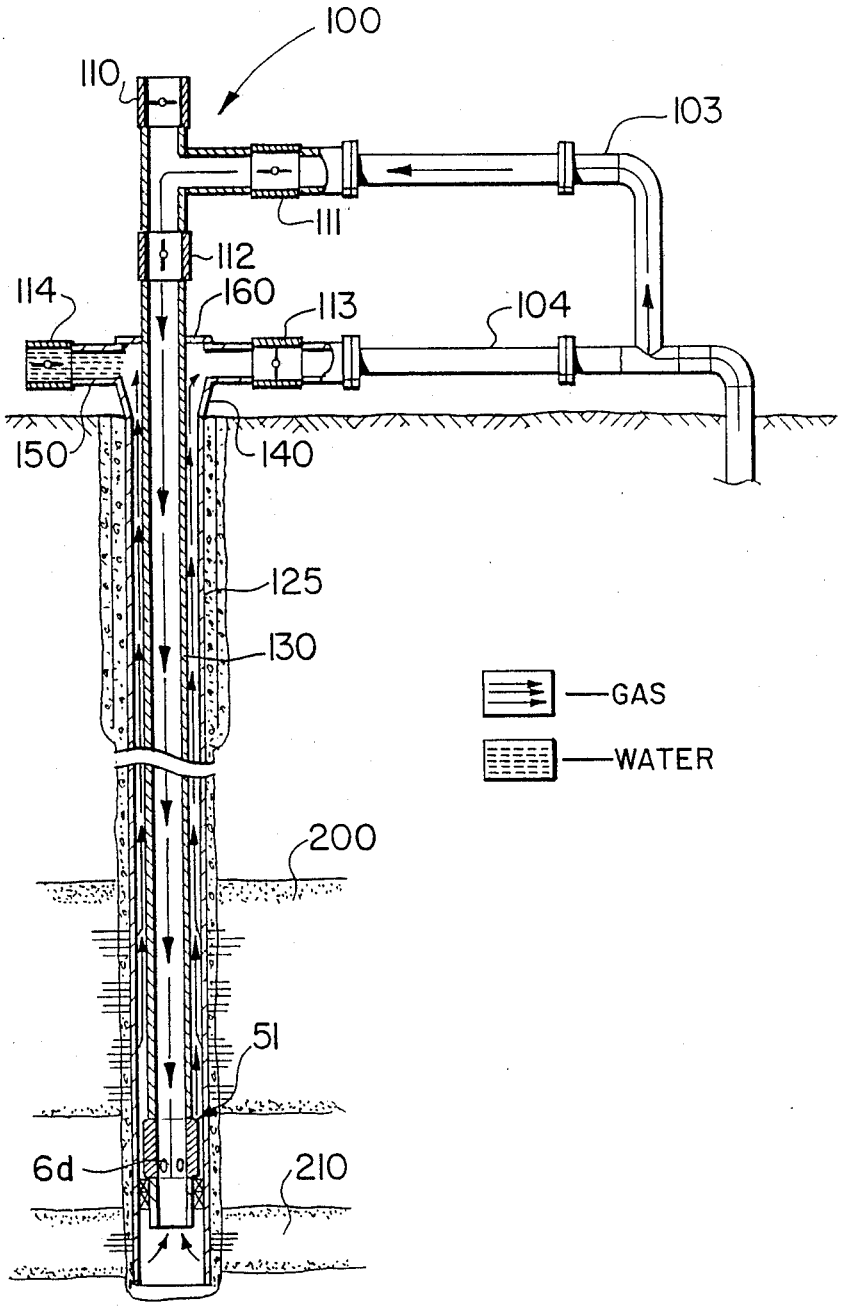
FIG. 5 illustrates the completion of the water removal process shown in FIG. 4.

FIG. 5 shows the last of the water column being ejected at the well head. Valve 114 is closely monitored during the ejections of incidental ground water from the well and is closed as soon as the bulk of the water has been ejected into a collection tank. Since valve ports *6d* (FIG. 1) are equally spaced around the bottom of the water column, the water is lifted from the well with very little gas intermixing, minimizing the loss of hydrocarbon to the atmosphere during the ejection of water from the well. Once valve 114 is closed, valve 113 is reopened and the well tubing string 130 is rotated in a counterclockwise direction to reclose ports *6d* in valve 51, returning the well to normal production as illustrated in FIG. 2.

The embodiments of the invention in which an exclusive property or privilege is claimed are defined as follows:

1. Sleeve valve for use in a gas production well, said valve adapted for connection to a well tubing string and operable to selectively open or close communication between the exterior of said tubing string and the interior of said tubing string and said valve comprising:

inner and outer valve components defining a continuous bore therethrough, said inner component being axially fixed but rotatable relative to said outer component and means for maintaining said components in axial alignment;

said inner component being adapted for attachment to said well tubing string with said valve bore communicating with the interior of said string and said inner component secured for rotation with said string;

said outer component adapted for attachment to means restraining said outer component from rotating with said inner component;

one or more ports extending through said outer component from the valve bore to the exterior of said valve;

a valve sleeve threadedly engaged with said inner component and axially slidable within said outer component but rotationally restrained whereby rotation of said inner component translates to axial movement of said valve sleeve within said outer component between respective positions wherein said ports are blocked or exposed by said valve sleeve; and sealing means between said inner and outer valve components preventing the passage of fluids or gases between said components.

2. A sleeve valve as defined in claim 1 wherein said outer component is adapted for connection to a segregation packer for said well.

3. A sleeve valve as defined in claim 1 further comprising bearing means rotatably supporting said inner component upon said outer component.

4. A sleeve valve as defined in claim 2, wherein said inner component comprises;

a hollow mandrel having upper and lower ends and, on its upper end, means for attachment to said well tubing string, an annular external shoulder region beneath said attachment means and provided on an edge remote from said attachment means with an annular groove adapted to provide an upper housing for a roller bearing and an elongated barrel extending downward from said annular shoulder region; and a collet attached to the lower end of said mandrel barrel, said collet having external and internal wall surfaces and provided on its internal wall surface adjacent at least the lower extremity thereof with a female threaded region coaxial with said collet.

5. A sleeve valve as defined in claim 3 wherein said outer component comprises:

a hollow mandrel having upper and lower ends and provided on its lower end with means for the attachment of a gas well segregation packer, an annular external shoulder region above said attachment means and a barrel portion extending upwardly from said shoulder, at least part of the internal bore of said mandrel being a cylindrical seal bore having said port or ports adjacent its lower end;

an elongated tubular sleeve having upper and lower ends and attached at its lower end to the barrel portion of said mandrel; and a collet attached to the upper end of said sleeve and having a longitudinal bore to rotatably accommodate a portion of said inner component of said valve and provided with an annular recess on its upper inside edge to form a lower housing for said bearing means.

6. A sleeve valve as defined in claim 1 wherein said valve sleeve comprises:

a hollow cylinder having upper and lower ends and on it upper end an exterior male spiral thread for threaded engagement with a complementary female thread on said inner component, an annular outwardly extending shoulder beneath said male thread, and a barrel portion extending downward from said shoulder and dimensioned to fit slidably within said outer component, said barrel portion being provided on its outside surface with a series of spaced apart annular grooves to accommodate sealing rings which close said ports through said outer component when said valve sleeve means is in its closed condition, and a vertical groove provided in said valve sleeve engaging with a guide pin extending inwardly from said second component and of sufficient length to permit axial sliding of said vavle sleeve between open and closed positions of said valve whilst restraining rotation of said valve sleeve.

7. A sleeve valve as defined in claim 3, wherein said bearing means comprises a first annular roller bearing disposed in a bearing housing formed by the lower surface of an annular exterior shoulder of said inner component and the upper end of a collet forming part of said outer component, to provide vertical support between said components.

8. A sleeve valve as defined in claim 7 further comprising a pair of juxtaposed radial thrust bearings disposed between the lower end of the collet of said outer component and the upper end of a collet forming part of said inner component to maintain said components in axial alignment.

9. Sleeve valve for use in a gas production well, said valve adapted for connection to a well tubing string and operable to selectively open or close communication between the exterior of said tubing string and the interior of said tubing string and said valve comprising:

inner and outer valve components defining a continuous bore therethrough, said inner component being axially fixed but rotatable relative to said outer component and means for maintaining said components in axial alignment;

said inner component being adapted for attachment to said well tubing string with said valve bore communicating with the interior of said string and secured for rotation with said string, and said inner component comprising a hollow mandrel having upper and lower ends and, on its upper end, means for attachment to said well tubing string, an annular external shoulder region beneath said attachment means provided on an edge remote from said attachment means with an annular groove adapted to provide an upper housing for a roller bearing and an elongated barrel extending downward from said annular shoulder region, and said inner component further comprising a collet attached to the lower end of said mandrel barrel, said collet having external and internal wall surfaces and provided on its internal wall surface adjacent at least the lower extremity thereof with a female threaded region coaxial with said collet;

said outer component comprising a hollow mandrel having upper and lower ends and provided on its lower end with means for the attachment of a gas well segregation packer, an annular external shoulder region above said attachment means and a barrel portion extending upwardly from said shoulder, at least part of the internal bore of said mandrel being a cylindrical seal bore having a port or ports adjacent the lower end of said bore, each said port extending through said mandrel to provide communication between the internal bore thereof and the exterior of said valve; an elongated tubular sleeve having upper and lower ends and attached at its lower end to the barrel portion of said mandrel; and a collet attached to the upper end of said sleeve and having a longitudinal bore to rotatably accommodate themandrel barrel of said inner component of said valve and provided with an annular recess on its upper inside edge to form a lower housing for said roller bearing;

a valve sleeve threadedly engaged with said inner component and axially slidable within said outer component but rotationally restrained whereby rotation of said inner component translates to axial movement of said valve sleeve within said outer component between respective positions wherein said ports are blocked or exposed by said valve sleeve, said valve sleeve comprising a hollow cylinder having upper and lower ends and on its upper end a coaxial male sprial thread for threaded engagement with said female thread of said inner component, an annular outwardly extending shoulder beneath said male thread and a barrel portion extending downward from said shoulder and dimensioned to fit slidably within said outer component, said barrel portion being provided on its outside surface with a series of spaced apart annular grooves to accommodate sealing rings which close said port or ports through said outer component mandrel when said valve sleeve means is in its closed condition, and a vertical groove provided in said valve sleeve engaging with a guide pin extending inwardly from said second component and of sufficient length to permit axial sliding of said valve sleeve between open and closed positions of the valve whilst restraining rotation of said valve sleeve; and sealing means between said inner and outer valve components preventing the passage of fluids or gases therebetween.

10. A sleeve valve as defined in claim 9, wherein said means for maintaining said inner and outer components in axial alignment comprises a pair of juxtaposed radial thrust bearings disposed between the lower end of the collet of said outer component and the upper end of the collet of said inner component.

11. A method of removing incidental water from a natural gas well bore utilizing a sleeve valve as set forth in claim 1 comprising:

attaching said outer component of said valve to a segregation packer and said inner component to a well tubing string;

sinking said segregation packer, said valve and said well tubing string down the casing of said well to a position intermediate an upper and a lower gas productive zone of said well;

attaching said well tubing string in a sealed, rotatable relationship with well tree equipment of said well;

rotating said tubing string to rotate said valve inner component and clsoe said valve to enable collection of natural gas from each said zone when there is little or not incidental water in said upper zone of said well;

rotating said valve inner component by rotation of said tubing string to open said valve and allow the gas pressure of either said lower zone or the gas pressure of a gas collection pipeline in connection therewith or both in unison, to lift a column of incidental water collected above said segregation packer and eject said water from said well; and rotating said tubing string to close said valve after the ejection of said incidental water from said well to resume normal production of natural gas from each said zone of said well.

12. A sleeve valve as defined in claim 1, wherein said inner component comprises:

a hollow mandrel having upper and lower ends and, on its upper end, means for attachment to said well tubing string, an annular external shoulder region beneath said attachment means and provided on an edge remote from said attachment means with an annular groove adapted to provide an upper housing for a roller bearing and an elongated barrel extending downward from said annular shoulder region; and a collet attached to the lower end of said mandrel barrel, said collet having external and internal wall surfaces and provided on its internal wall surface adjacent at least the lower extremity thereof with a female threaded region coaxial with said collet.

* * * * *

UNITED STATES PATENT AND TRADEMARK OFFICE

CERTIFICATE OF CORRECTION

PATENT NO. : 4,823,880

DATED : April 25, 1989

INVENTOR(S) : Wayne Klatt

It is certified that error appears in the above-identified patent and that said Letters Patent is hereby corrected as shown below:

Column 1, line 6:

"value" should be --valve--.

Column 1, line 9:

"bore" should be --bores--.

Column 1, line 12:

"is" should be --are--.

Column 1, line 38:

"haveing" should be --having--.

Column 1, line 38:

After "having" insert --a--.

Column 1, line 42:

"wate" should be --water--.

Column 2, line 16:

"valve" should be --valves--.

Column 2, line 53:

"vale" should be --valve--.

UNITED STATES PATENT AND TRADEMARK OFFICE

CERTIFICATE OF CORRECTION

PATENT NO. : 4,823,880

DATED : April 25, 1989

INVENTOR(S) : Wayne Klatt

It is certified that error appears in the above-identified patent and that said Letters Patent is hereby corrected as shown below:

Column 2, line 62:

"wherein the or each said port is" should be --wherein said ports--.

Column 3, line 4:

"mandresl" should be --mandrels--.

Column 3, line 7:

"parst" should be --parts--.

Column 3, line 27:

"small" should be --sealing--.

Column 3, line 68:

"component" should be --components--.

Column 4, line 4:

"bore" should be --bores--.

Column 4, line 7:

"section" should be --sleeve--.

UNITED STATES PATENT AND TRADEMARK OFFICE

CERTIFICATE OF CORRECTION

PATENT NO. : 4,823,880

DATED : April 25, 1989

INVENTOR(S) : Wayne Klatt

It is certified that error appears in the above-identified patent and that said Letters Patent is hereby corrected as shown below:

Column 4, line 20:

"comprses" should be --comprises--.

Column 4, line 21:

"wiht" should be --with--.

Column 4, line 36:

"sprial" should be --spiral--.

Column 4, line 42:

"material" should be --mandrel--.

Column 4, line 43:

"sprial" should be --spiral--.

Column 5, line 37:

After "of" insert --the--.

Column 5, line 53:

"referecne" should be --reference--.

Column 5, line 61:

"sapce" should be --space--.

UNITED STATES PATENT AND TRADEMARK OFFICE

CERTIFICATE OF CORRECTION

PATENT NO. : 4,823,880

DATED : April 25, 1989

INVENTOR(S) : Wayne Klatt

It is certified that error appears in the above-identified patent and that said Letters Patent is hereby corrected as shown below:

Column 6, line 10:

"bowel" should be --bowl--.

Column 6, line 10:

"wiht" should be --with--.

Column 6, line 19:

"teh" should be --the--.

Column 6, line 26:

"each" should be --that--.

Column 6, line 46:

"prductive" should be --productive--.

Column 6, line 54:

"ofthe" should be --of the--.

Column 8, claim 6, line 53:

"it" should be --its--.

Column 8, claim 6, line 68:

"vavle" should be --valve--.

UNITED STATES PATENT AND TRADEMARK OFFICE

CERTIFICATE OF CORRECTION

PATENT NO. : 4,823,880

DATED : April 25, 1989

INVENTOR(S) : Wayne Klatt

It is certified that error appears in the above-identified patent and that said Letters Patent is hereby corrected as shown below:

Column 9, claim 9, line 61:

"themandrel" should be --the mandrel--.

Column 10, claim 9, line 6:

"sprial" should be --spiral--.

Column 10, claim 11, line 46:

"clsoe" should be --close--.

Signed and Sealed this

Fifteenth Day of May, 1990

*Attest:*

HARRY F. MANBECK, JR.

*Attesting Officer*

*Commissioner of Patents and Trademarks*